US005617605A

United States Patent [19]

Hoerner et al.

[11] Patent Number: 5,617,605

[45] Date of Patent: Apr. 8, 1997

[54] COMBINATION CLEANING AND PLUNGER TOOL

[75] Inventors: Nikolaus N. Hoerner, Des Plaines, Ill.; Paula J. Hoerner, 621 Central St., Evanston, Ill. 60201

[73] Assignee: Paula J. Hoerner, Evanston, Ill.

[21] Appl. No.: 389,930

[22] Filed: Feb. 16, 1995

[51] Int. Cl.[6] ..... A46B 5/02; A47L 25/00

[52] U.S. Cl. ..... 15/105; 15/143.1; 15/160; 15/248.1; 294/1.1; 7/170; 81/488; D4/116; D32/35

[58] Field of Search ..... 15/105, 111, 113, 15/117, 143.1, 144.3, 144.4, 159.1, 160, 248.1; 4/286, 292, 295; 294/1.1, 2; 7/170; 81/488; D4/116; D32/35, 42

[56] References Cited

U.S. PATENT DOCUMENTS

| | | | |
|---|---|---|---|
| D. 218,728 | 9/1970 | Busse | D4/116 |
| D. 274,273 | 6/1984 | Auerbach | D4/116 |
| 1,053,875 | 2/1913 | Repper et al. | 4/286 |
| 1,437,794 | 12/1922 | Cleveland | 15/160 |
| 1,935,128 | 11/1933 | Pullman | 4/286 |
| 3,427,636 | 2/1969 | Seifert | 15/105 |
| 3,765,275 | 10/1973 | Johnson | 15/105 |
| 4,504,996 | 3/1985 | Loos | 15/105 |
| 4,745,642 | 5/1988 | Shands | 4/292 |
| 5,377,362 | 1/1995 | Jackson | 4/292 |

*Primary Examiner*—Mark Spisich

*Attorney, Agent, or Firm*—Dressler, Goldsmith, Milnamow & Katz, Ltd.

[57] ABSTRACT

A combination cleaning and plunger tool consisting of a handle portion having at one end a brush for cleaning surface areas. The other end of the tool includes a cylindrical plunger portion which can be used to move refuse from the bottom of a sink into a garbage disposal unit. Located between the plunger and handle portion is a plate member including depending legs. The plate member is larger than the drain opening of a sink and the plunger is smaller than the drain opening, so that the plunger can force material through the drain opening and the plate will limit the movement of the plunger. The plate is provided with legs so that liquid can freely flow into the drain opening when the tool is used during the plunging action or when it is merely in a stored position with the plunger located in the drain opening when it is not being used.

9 Claims, 1 Drawing Sheet

COMBINATION CLEANING AND PLUNGER TOOL

BACKGROUND OF THE INVENTION

This invention relates to a unitary tool that can be used for cleaning up the debris in a sink and moving such debris into a sink drain. Once in the sink drain, the tool can be used to force the debris down into the chamber of a garbage disposal where it is ground up and washed away.

It has been common practice during the washing of dishes that the material on the dishes is swept off the item to be cleaned into the sink by a brush and the material is then subsequently forced down through the sink drain into the chamber of a refuse grinder such as a garbage disposal unit where it is chopped up and disposed of. As aforementioned, a brush is used for the cleaning action and for directing the garbage into the sink drain. At that point, the dish washer usually uses his hand or a separate plunger tool to force the material down through the sink drain into the garbage disposal chamber. Needless to say, using one's hand, this is very awkward and cumbersome and could potentially subject the person forcing the material into the drain to a potential injury or at the very least cause soiling the hands and possibly adjacent clothing.

Another problem that often arises with a plunging device such as a utensil used in conjunction with an electrical disposal unit is that the plunging device could come into direct contact with the moving electrical blades which would disintegrate the utensil and result in flying particles which would be hazardous to anyone in the immediate area.

Accordingly, it can be appreciated that if one were to have available to them a combination brush and plunger tool which would be used as a brush to move the material into the sink drain and then simply repositioned to force the material through the sink drain into the chamber where it is to be ground up by the garbage disposal, potential injury and clothing damage would be eliminated. It would also be desirable if the tool could be conveniently stored yet be readily accessible for use.

SUMMARY OF THE INVENTION

In accordance with the present invention, there is provided a single handle combination cleaning and plunger tool that contains at one end a brush that can be used to brush any of the debris found in a sink into the sink drain. The brush has an angularly disposed head to facilitate efficient cleaning of the sink. At the other end of the brush is provided a plunger member which is of a smaller size than the drain opening and thus after brushing, the tool can be rotated to use the plunger which is moved through the sink drain to force the material therein into the garbage disposal chamber. The plunger is of a length to insure that it would not contact the moving blades of a disposal unit. Also, if desired, the plunger could be designed to better fit the hand and act as a second brush handle.

Between the handle of the brush and the plunger portion of the tool, there is provided a flat plate-like member which is of a design to fit over the sink drain and therefore can be left in this position when not in use. In order to permit normal liquid drainage out of the sink, the plate is formed with a plurality of legs which spaces the plate above the base of the sink to allow water, or the like, to flow continuously from the sink into its drain. The plate also acts as a shield to protect the user from water or debris when the plunger portion is used to move debris into the disposal chamber. If desired, the handle can be designed to telescope into the plunger portion to reduce the height of the brush above the base of the sink. The handle and plunger portion are made in separate pieces and they are secured in the plate relative thereto by means of a washer which permits longitudinal movement of the handle within the plunger portion. The grip of the washer is sufficiently tight to retain the brush handle in position when the handle has been moved to a preset position yet will allow movement with respect thereto. The position can either be elongated as illustrated or have a reduced length if desired.

BRIEF DESCRIPTION OF THE DRAWINGS

Various aspects of the invention will be more fully understood upon consideration of the following description and the accompanying drawings in which.

DESCRIPTION OF A PREFERRED EMBODIMENT

Figure 1:
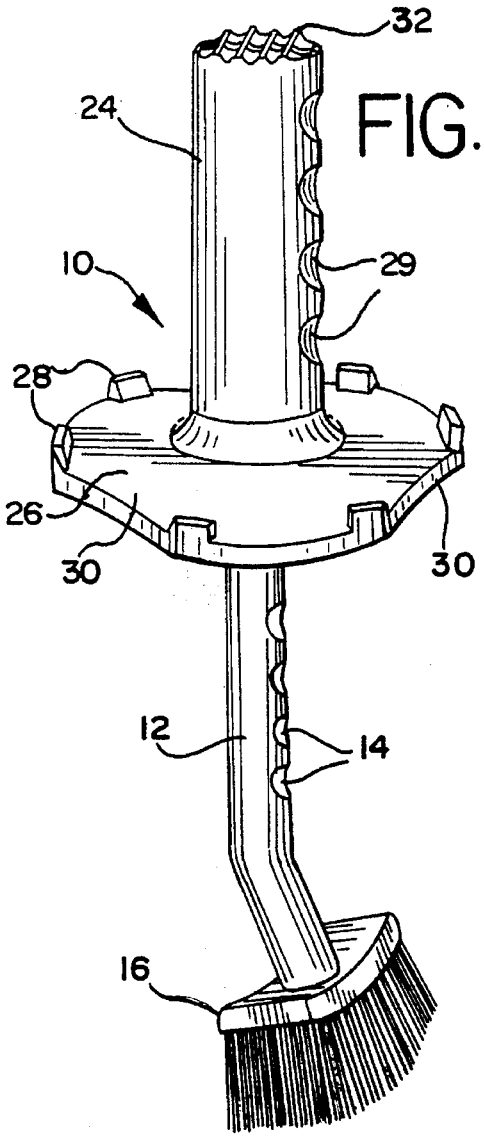
FIG. 1 is a perspective view of the novel combination cleaning and plunger tool.
Figure 2:
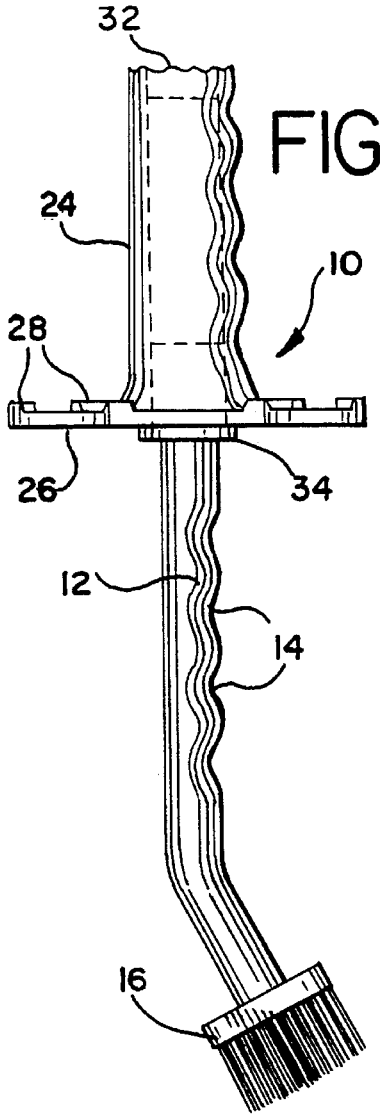
FIG. 2 is a side elevation view of the combination tool.
Figure 3:
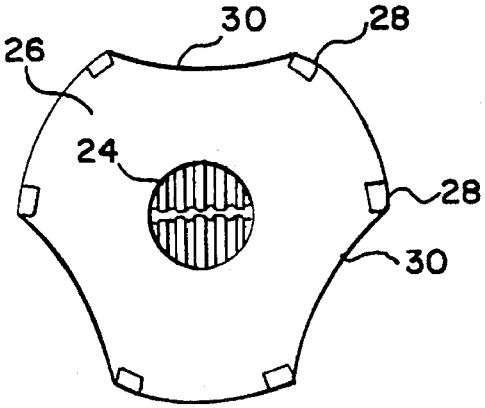
FIG. 3 is a top plan view of the tool.

Referring first to FIG. 1, there is shown in perspective the novel cleaning and plunging tool 10 containing a handle 12 that can be hollow if it is desired to use it as a receptacle for soap that can be dispensed into the brush. The handle 12 has finger grip portions 14 so that the tool can be gripped either during the brushing action or the plunging action.

Located at the end of the handle 12 is a brush 16 which contains a plurality of bristles for cleaning debris off of dishes, etc., as well as the base of the sink 20 and for directing the garbage material into the sink drain opening 22. The end portion of the handle 12 is angled to facilitate cleaning of the various surfaces to which it is to be applied. Located at the other end of the tool is a plunger 24 for forcing material moved into the sink drain by the brush into the chamber of the garbage disposal unit. The plunger can also be used as a handle during the brushing action if desired.

Figure 4:
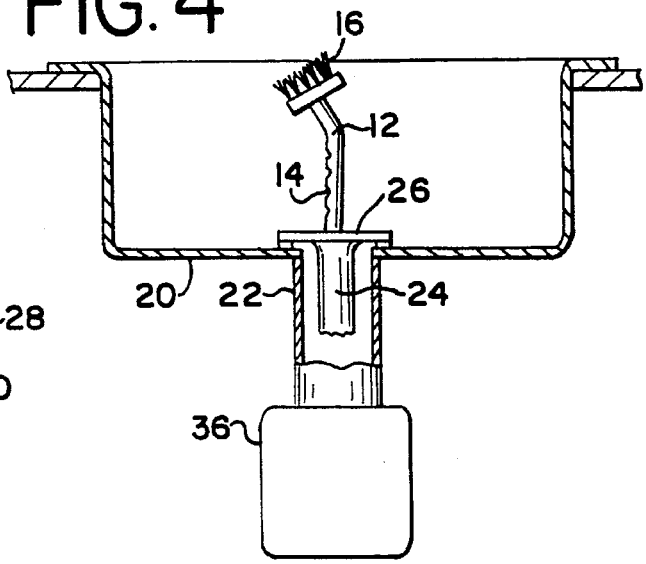
FIG. 4 is a view showing the tool located in position in the sink during non-use.

Located intermediate the brush and plunger is a flat plate 26 that includes a plurality of circumferentially spaced depending leg portions 28 which as shown in FIG. 4 spaces the plate 26 from the bottom of the sink 20 to permit water or other liquid to flow from the sink 20 between the legs 28 into the sink drain 22. Plate 26 also acts as a protective shield during the plunger action and includes arcuate sections 30 to further facilitate the flow of water past the tool 10 into the sink drain 22. The plunger portion 24 of the tool 10 is hollow and includes a ridged end section 32 to facilitate directing other material into the sink drain 22. The plunger can also be formed to include finger grips 29 to be used when the tool is used for brushing. The hollow feature of the plunger 24 permits the handle 12 which is fixed in place relative to the plate by the washer 34 to be moved into the hollow plunger if it is desired to reduce the extended section of the handle.

By referring specifically to FIG. 4, there is seen the combination tool 10 located in a stored position in the sink 20. In this position, it can be seen that water flowing into the sink can flow underneath the plate 26 and between the legs 28 into the drain 22 from where it can flow to the garbage disposal unit 36.

It is, of course, intended to cover by the appended claims all such modifications that fall within the true spirit and scope of the invention.

What is claimed is:

1. A tool for cleaning surfaces and forcing material into a refuse grinder opening, said tool comprising a brush at one end and a plunger means at another end thereof opposite said one end and a baffle assembly disposed intermediate said ends which includes a flat plate and a plurality of legs depending therefrom whereby the plate will be supported above said opening and liquid can flow between said legs into said grinder opening when the plunger means is located therein, said plunger means being smaller than said opening and the baffle assembly being larger than said opening but defining relatively large passageways to permit liquid to flow into said opening as the refuse is being pushed into said refuse grinder opening by said plunger means.

2. A tool as set forth in claim 1 in which the baffle assembly defines a plurality of arcuate sections between adjacent pairs of legs.

3. A tool as set forth in claim 1 in which the plate acts as a protective shield to prevent debris from being directed back out of the refuse grinder opening.

4. A tool as set forth in claim 1 in which the plunger means defines handle gripping portions whereby the plunger means section can be used as a handle for the brushing action.

5. A tool as set forth in claim 1 in which the plunger means portion of said tool consists of a cylindrical member and the brush includes a head portion formed of bristles secured to a base that is connected to a rod extending from the end of said tool opposite to said cylindrical member and the end portion of the rod containing the brush is angled from the balance of the rod to facilitate cleaning of the surface to which it is applied.

6. A tool for cleaning surfaces and forcing material into a refuse grinder opening, said tool comprising a brush at one end including a head portion formed of bristles secured to a base that is connected to a rod which rod includes a handle portion with gripping sections whereby the tool can be readily grasped and the end portion of the rod containing the brush is angled from the balance of the rod to facilitate cleaning of the surface to which it is applied and plunger means at another end thereof disposed opposite said one end and consisting of a hollow cylindrical member to slidably receive said rod said brush extending from the end of said tool opposite to said cylindrical member, and a baffle assembly disposed intermediate said ends, said plunger means being smaller than said opening and the baffle assembly being larger than said opening but defining relatively large passageways to permit liquid to flow into said opening as the refuse is being pushed into said refuse grinder opening by said plunger means, the tool being adapted to be used as a brush or a plunger as desired.

7. A tool as set forth in claim 6 in which the baffle assembly consists of a flat plate and the rod extends through a washer secured to said plate whereby the rod can be adjustably positioned relative to said plate.

8. A tool as set forth in claim 6 in which the plunger means, baffle assembly and rod are made of plastic and the plunger means is fitted into said baffle assembly.

9. A tool for cleaning surfaces and forcing material into a refuse grinder opening, said tool comprising a brush at one end including a head portion formed of bristles secured to a base that is connected to a rod and plunger means at another end thereof disposed opposite said one end and consisting of a hollow cylindrical member to slidably receive said rod said brush extending from the end of said tool opposite to said cylindrical member, and a baffle assembly disposed intermediate said ends, said plunger means being smaller than said opening and the baffle assembly being larger than said opening but defining relatively large passageways to permit liquid to flow into said opening as the refuse is being pushed into said refuse grinder opening by said plunger means.

* * * * *